United States Patent [19]

Bentley

[11] 4,223,489

[45] Sep. 23, 1980

[54] INSULATION STOP

[76] Inventor: Billy E. Bentley, 212 Avon Ct., Port Orange, Fla. 32019

[21] Appl. No.: 964,592

[22] Filed: Nov. 29, 1978

[51] Int. Cl.[2] ..... E04B 1/74; F24F 7/00

[52] U.S. Cl. ..... 52/92; 52/317

[58] Field of Search ..... 52/92, 94, 178, 189, 52/95, 90, 315

[56] References Cited

U.S. PATENT DOCUMENTS

| | | | |
|---|---|---|---|
| 3,863,553 | 2/1975 | Koontz | 52/95 |
| 4,069,628 | 1/1978 | Kreimer | 52/94 |

*Primary Examiner*—James L. Ridgill, Jr.
*Attorney, Agent, or Firm*—John N. Randolph

[57] ABSTRACT

An insulation stop for use in buildings, such as a dwelling, having truss type roof, and which is capable of confining any type of insulating material to the area directly above the ceiling, while providing maximum space between the roof rafters and the underside of the roof for full flow of ventilation, to thereby materially reduce the energy required for air conditioning the building, as well as the cost involved. The invention consists of a single sheet, preferably of fibrous material, or which could be composed of light weight metal or plastic capable of being bent and folded. A plurality of such items are utilized to form the insulation stop for a complete building with one such item associated with and disposed in part between adjacent roof rafters.

4 Claims, 3 Drawing Figures

INSULATION STOP

SUMMARY

It is a primary object of the present invention to provide an insulation stop of extremely simple construction which may be very economically manufactured and which can be quickly and easily installed, for confining ceiling insulation without obstructing ventilation between the roof and ceiling.

Another object of the invention is to provide an insulation stop requiring no modification, except bending from its flat initial forms, to position it to be readily secured, as by stapling.

Various other objects and advantages of the invention will hereinafter become more fully apparent from the following description of the drawing, illustrating a presently preferred embodiment thereof, and wherein:

DESCRIPTION OF THE PREFERRED EMBODIMENT

Figure 1:
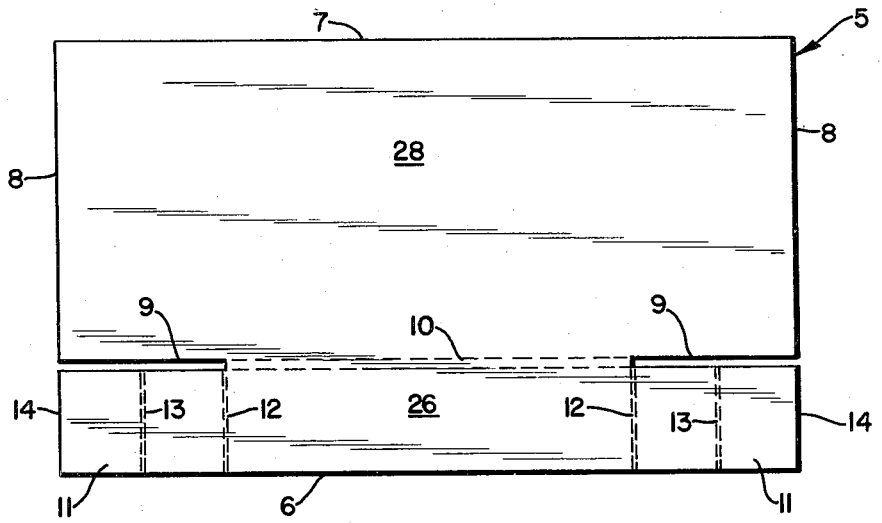
FIG. 1 is a plan view of one of the insulation stops shown in its blank or flat form.

Referring more specifically to the drawing, the insulation stop in its entirety and comprising the invention as illustrated in FIG. 1 is designated generally 5 and comprises a single substantially rectangular sheet, preferably of a fibrous material, but which could be composed of plastic, thin metal, or the like. The sheet 5 has a bottom edge 6, a top edge 7, and corresponding end edges 8. The sheet 5 is cut inwardly from its two ends 8 to provide slots 9 which align with one another and which have inner ends terminating a substantial distance apart. Sheet 5 has a crease or fold line 10 extending between and aligning with the slots 9. Said slots and the crease line are located in close proximity to the bottom edge 6 and remote from the top edge 7. Slots 9 combine with end portions of the bottom edge 6 to provide tongues or tabs 11 each of which is of the same length as one of the slots 9. The tabs 11 are attached to the sheet or body 5 each by a fold line 12 which extends between the inner end of the slot 9, forming said tongue 11, and the continuous portion of the bottom edge 6 which is coextensive with said slot 9. Each tab or tongue 11 may be provided with an additional fold line or fold lines 13 located at a suitable distance between its fold line 12 and its free edge 14.

Figure 2:
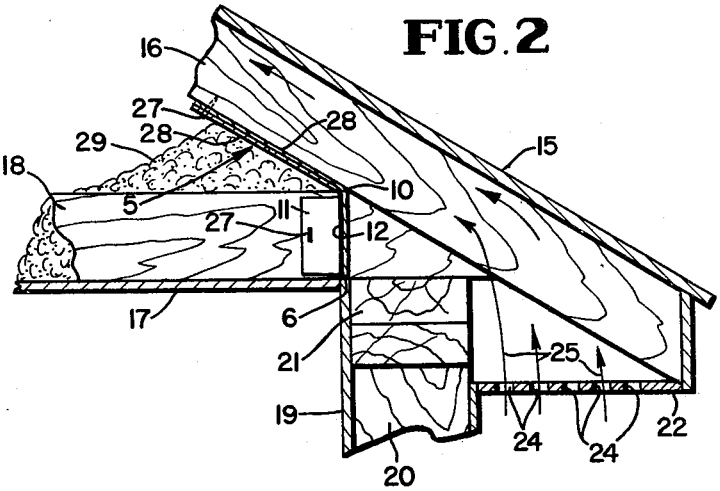
FIG. 2 is a fragmentary vertical sectional view through a portion of a building having a truss type roof, showing a part of the side wall, ceiling, roof and soffit, and showing one of the insulation stops applied.

FIG. 2 shows a portion of a conventional wooden building including a part of the roof 15, one of the roof rafters 16, a part of the ceiling 17, a part of a ceiling joist 18 disposed on edge above the ceiling 17, a part of a side wall 19 which is secured to wall studs 20 and a top plate 21. A soffit 22 which extends outwardly from the studs 20 has vent openings 24 for circulation of air, as indicated by the arrows 25, inwardly through the vents 24 and across the building between the roof 15 and ceiling 17.

Figure 3:
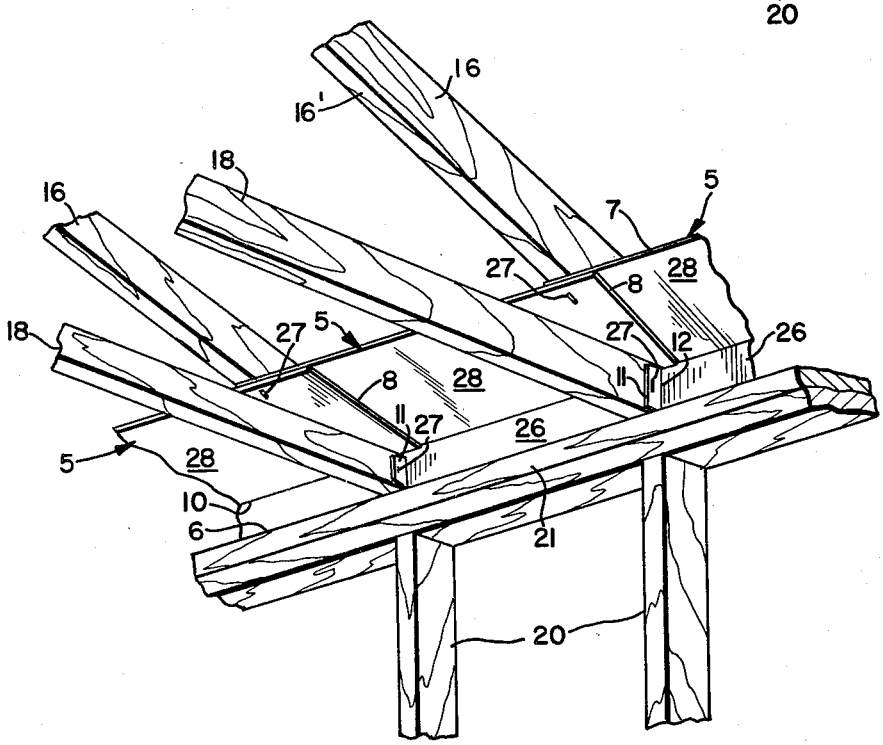
FIG. 3 is a perspective view looking from below and to the left of FIG. 2, with certain of the parts omitted, for clarity, and showing at least portions of several of the insulation stops in applied positions.

FIG. 3 illustrates a portion of the building structure shown in FIG. 2, including parts of two wall studs 20, two ceiling joists 18, two roof rafters 16 and a top plate 21. One insulation sheet 5 is shown complete in an applied position, together with adjacent end portions of two additional insulation sheets 5. The insulation stop sheets 5, as shown, are folded along their fold lines 10 and along either the fold lines 12 or 13, depending upon the spacing between the ceiling joists 18 and the portion of the sheet 5, disposed between the tabs 11 and between the fold line 10 and bottom edge 6, to provide an upright wall portion 26 the bottom edge of which rests on either the top plate 21, wall 19 or ceiling 17. The two inturned tongues or tabs 11 are spaced a proper distance apart to lie flush against adjacent sides of the two adjacent ceiling joists 18, and are secured thereto by means of suitable driven fastenings 27, such as staples. The longer and wider portion of the sheet 5, formed by the remainder thereof which extends between the ends 8 and between the top edge 7 and the crease line 10 and slots 9, forms a long wide panel 28 which is folded inwardly on the crease line 10 to form an angle corresponding to the angle formed by the ceiling joists 18 and roof rafter 16. As seen in FIG. 3, each panel 28 spans adjacent roof rafters 16 and underlies portions of the bottom surfaces 16' thereof. Additionally, adjacent ends of the panels 28 of adjacent insulation stop sheets 5 overlap one another, as seen in FIG. 3, and are secured by additional driven fastenings 27 to said bottom surfaces 16' of the rafters 16.

The assembled insulation stop sheets 5, as heretofore described and illustrated in the drawing, will provide an effective stop for retaining insulation 29 of any type on the ceiling 17 and between the joists 18. This will not only prevent such insulation 29 from escaping outwardly from between the joists but will also keep the insulation from being blown around on the ceiling so as to leave portions of the ceiling without insulation or with insulation of insufficient thickness. As seen in FIG. 2, air can enter through the vents 24, as indicated by the arrows 25, and can flow upwardly under the roof 15, between the ceiling rafters 16 and between portions of the roof 15 and the applied wall surface formed by the overlapping and interconnecting panels 28, so as to permit free circulation of air beneath the roof for cooling the ceiling 17 to thereby greatly reduce the energy required to air condition the building, of which said ceiling 17 forms a part, as well as minimizing the cost of the energy utilized.

Various modifications and changes are contemplated and may be resorted to, without departing from the function or scope of the invention.

I claim as my invention:

1. An insulation stop comprising, in combination with two adjacent roof rafters, a rectangular sheet having a top edge and a bottom edge, said sheet having slots disposed parallel to said edges and extending inwardly from the ends thereof, said slots being in alignment with one another and terminating a substantial distance apart to form attaching tongues between end portions of said bottom edge and said slots, said tongues extending substantially perpendicular from the plane of the sheet in the same direction and being spaced apart a distance corresponding to the spacing between adjacent sides of adjacent ceiling joists against which said tongues abut and are secured, the part of said sheet disposed between said tongues constituting a vertical wall closing the opening between said joists, said sheet having a fold line extending between adjacent ends of said slots, said fold line and the slots, said top edge and the end portions disposed between the slots and top edge, combining to form a large flat panel disposed at an oblique angle to said upright wall and extending between said adjacent roof rafters and in an underlying relationship to bottom surfaces thereof, and means securing said panel to said bottom surfaces of the roof rafters to combine with said upright wall to form an insulation stop and with portions of the roof and said two roof rafters to provide a passage for the free circulation of air from the surrounding atmosphere between the roof and ceiling.

2. An insulation stop as in claim 1, a plurality of said insulation stops being secured to adjacent ceiling joists and adjacent roof rafters to provide a continuous insulation stop composed of a narrow upright wall and a wide inclined wall each of which is uninterrupted.

3. An insulation stop as in claim 1, each of said tongues having at least one fold line along which the tabs are folded from coplanar positions to substantially parallel positions relative to one another.

4. An insulation stop as in claim 3, said fold line being spaced apart a distance corresponding to the spacing between the adjacent sides of adjacent ceiling joists.

* * * * *